United States Patent [19]

Goupil et al.

[11] 4,084,818

[45] Apr. 18, 1978

[54] HOCKEY STICK WITH REINFORCEMENT FILAMENT WINDING

[76] Inventors: Marcel Goupil, 948 Chasse Street; Marc Ruel, 265 Lemire Boulevard, both of Drummondville, Quebec, Canada

[21] Appl. No.: 759,312

[22] Filed: Jan. 14, 1977

[51] Int. Cl.[2] ..... A63B 59/14

[52] U.S. Cl. ..... 273/67 A

[58] Field of Search ..... 273/67 R, 67 A, 72 R, 273/73 R, 73 F, 82 R, DIG. 7, DIG. 23

[56] References Cited

U.S. PATENT DOCUMENTS

| | | | |
|---|---|---|---|
| 2,923,652 | 2/1960 | Oka | 273/DIG. 7 |
| 3,115,912 | 12/1963 | Harris | 273/82 R X |
| 3,353,826 | 11/1967 | Traverse | 273/67 A |
| 3,433,696 | 3/1969 | Michael | 273/73 F X |
| 3,598,410 | 8/1971 | Costopoulos | 273/82 R |
| 3,813,098 | 5/1974 | Fischer et al. | 273/67 A X |
| 3,982,760 | 9/1976 | Tiitola | 273/67 A |

FOREIGN PATENT DOCUMENTS

| | | | |
|---|---|---|---|
| 591,454 | 1/1960 | Canada | 273/67 A |
| 42,515 | 4/1970 | Finland | 273/67 A |
| 90,729 | 1/1958 | Norway | 273/67 A |

*Primary Examiner*—Richard J. Apley

[57] ABSTRACT

A hockey stick in which the blade and the junction of the blade with the handle are reinforced by a winding of a high tensile strength yarn adhered with an epoxy resin or other appropriate adhesive. The yarn is wound under tension in spiral and does not intersect itself, so that the hockey stick is covered with only one layer of the yarn. Preferably, woven fiberglass sheets are positioned against the sides and the bottom edge of the blade underneath the yarn winding which holds said sheets in position during manufacture; preferably, also, a heel portion of plastic material is applied against the wooden heel and surrounded by the woven fiberglass sheet and the yarn winding.

4 Claims, 3 Drawing Figures

HOCKEY STICK WITH REINFORCEMENT FILAMENT WINDING

Figures 1, 2, 3:
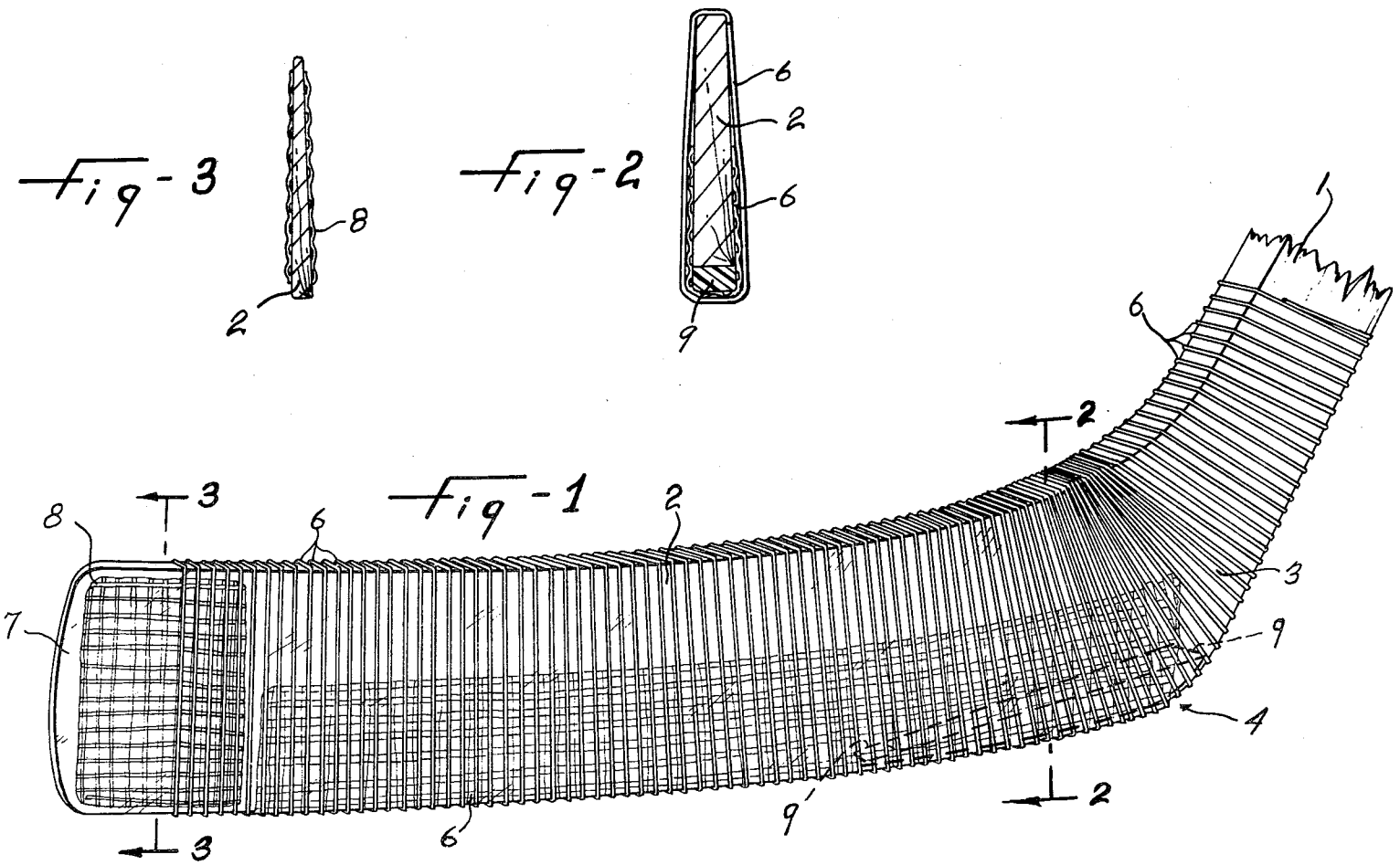

The present invention relates to a hockey stick, more particularly to a hockey stick provided with means for reinforcing the blade and heel portion thereof.

It is known to reinforce the blade and junction between the handle and the blade in a hockey stick by winding a tape around these portions, the tape being made, for instance, of fiberglass woven fabric. Due to the angular relationship of the blade with the handle, it is impossible, while using a tape, for instance of ¼ inch width, of obtaining equal tension across the width of the tape and of avoiding overlapping of the tape windings at the top edge of the heel portion if one wants to avoid undue spacing of the winding at the bottom edge of the heel portion with resulting reinforcement in this area. This results in excessive weight increase of the hockey stick relative to the reinforcement obtained, it being known that a hockey stick must be kept as light as possible. Using woven tape adds also unuseful weight, since the weft threads serve no useful purpose, only the warped threads being effective to prevent splitting of the wooden handle and blade. Moreover, using a tape with overlaps results in an irregular surface, especially at the heel portion, which often diminishes the shooting accuracy.

It is a general object of the invention to provide a hockey stick with a reinforcement which avoids the above disadvantages.

It is another object of the invention to provide a hockey stick in which the reinforcement also serves to simplify manufacture of the reinforced hockey stick.

In accordance with the invention, the hockey stick is characterized by the fact that at least part of the blade and the heel portion are reinforced by a high tensional strength yarn, for instance of fiberglass, polyester or polypropylene, wound in a single layer under suitable tension in a spiral around the handle, the heel and the blade, and wherein the yarn does not intersect itself but forms a single layer, resulting in a properly reinforced blade and heel portion with a minimum of added weight.

The foregoing and other objects of the present invention will become more apparent during the following disclosure and by referring to the accompanying drawings, in which:

FIG. 1 is a side view of the lower end of a hockey stick in accordance with the invention; and FIGS. 2 and 3 are cross-sections taken along lines 2—2 and 3—3 respectively of FIG. 1.

In the drawings, like reference characters indicate like elements throughout.

The hockey stick includes the usual handle 1 and blade 2 defining at their angular junction 3, a heel portion 4. In most cases, the handle 1 and blade 2 are made of wood and are rigidly assembled together by a glued lap joint in the junction area 3.

One or more yarns, of a high tensile strength material, such as fiberglass, polyethylene or polypropylene, indicated at 5, are wound around part of the handle 1, the junction area 3 and at least the major part of the blade 2. The winding 5 does not intersect itself and forms a single layer of yarn. In the case of fiberglass, the yarn is a continuous strand of fine glass fibers. When using polymers, such as polyethylene or polyethylene, the yarn is preferably in the form of a monofilament.

Each coil of the winding is kept as nearly perpendicular as possible to the long axis of the blade and of the handle. The angle with the perpendicular, in general, does not exceed 12°. Because the yarn has a small diameter and is kept as perpendicular as possible to the long axis of the handle and blade, the yarn has all its tensional strength applied to compress the wood of the stick perpendicular to the long axis and is very effective in preventing splitting of the wood. On the contrary, when using a tape, the tape winding in area 3 is only partly effective, since it cannot apply compression to the stick over its entire width.

In practice, the tension applied to the winding amounts to between 20% and 50% of the total tensional strength of the yarn. For instance, using a fiberglass yarn of a size equivalent to 3,600 yards per pound, a tension of 5 to 10 pounds is applied to the yarn filament during winding.

Preferably, a sheet 6, of woven fabric of glass fibers, is folded to form a U-shaped cross-section to embrace part of the sides of the blade, the blade lower edge, and to extend across the heel 4. This fabric 6 is located between the wood and the winding 5. The fabric 6 terminates short of the outer end 7 of the blade 2 and two other pieces of glass fiber woven fabric 8 are also preferably applied against the sides of the outer end of blade 2, but do not extend over the lower edge of the blade. These pieces 8 are partly covered by the winding 5. Preferably, also, a heel part 9, made of a synthetic resin, such as polystyrene, is glued directly to the wood at the heel edge portion 4 and is disposed between the wood and the piece of fabric 6. Heel part 9, fabrics 6 and 8 and winding 5 are covered by a layer of adhesive, such as epoxy glue, which adheres to and covers blade 2 and the lower end of handle 1.

The method of hockey stick reinforcement is preferably as follows.

The heel part 9 is glued to the bottom edge of the heel 3. The blade 2 and the lower part of the handle 1 are dipped into a bath of epoxy glue, of low viscosity, substantially the same as the viscosity of paint. The piece of fabric 6 and the pieces 8 are then immediately manually applied to the blade and the yarn 5 is thereafter wound around the hockey stick by means of a suitable machine. After completion of the winding, the hockey stick is again dipped in an epoxy bath of low viscosity and then left to dry. About twenty-four hours after drying and hardening of the epoxy glue, the hockey is subjected to a sanding operation to remove the few asperities left by the fiberglass fabric.

It will be noted that the yarn windings serve, during manufacture, to firmly retain the fabrics 6 and 8 in proper position and to confine the same so that very little final sanding is required. In the case where no fabric reinforcement is used, for instance in the case of a hockey stick for young players, sanding is not required. The yarn is preferably wound as several, for instance four, parallel yarns, each of a size of about 3,600 yards per pound from two slits spaced about ⅛ inches apart. The four yarns do not intersect each other in the winding, whereby only one layer of winding is obtained.

To be able to wind under tension, a spot of adhesive is first applied to the handle 1 where the initial end of the yarn is pressed and another spot of adhesive is applied to the blade to receive the trailing end of the winding. The pitch of the winding can be modified in accordance with the need; it can be varied along the stick to obtain a greater reinforcement of the weakest parts of the stick, for instance at the junction 3.

By making the heel part 9 out of polystyrene and then dipping the stick in an epoxy glue with a proper solvent, it has been found that the solvent dissolves the outer surface of the polystyrene of the heel part 9, resulting in a perfect bonding of the polystyrene, the fiberglass and the epoxy. The winding mechanically retains the sheets 6 and 8 in proper position and against displacement during the final dipping of the stick in the epoxy bath.

Laboratory tests carried out with the reinforced hockey stick in accordance with the invention have proven that the blade is much more difficult to split than a blade without the winding. For instance, if one drives a cold chisel of 1 inch diameter across the blade about 2 inches from the outer end 7 of the blade at the mid-center of the blade, the blade without reinforcement will split up to its outer end. The same test made with a blade provided with the fabrics 6 and 8 and with the winding of the invention will result in a hole of 1 inch diameter; but the blade does not split.

The reinforcement of the invention adds very little weight to the hockey stick, compared to the amount of the effective reinforcement obtained.

What we claim is:

1. A hockey stick having a handle and a blade connected to the handle at an angle by means of a junction area, part of the handle, the junction area and at least part of the blade being covered by a spiral winding of a high tensional strength continuous yarn wound in a single layer without intersection of the yarn, the tension applied to the winding amounting to between 20% and 50% of the total tensional strength of the yarn, each coil of the yarn being inclined not more than 12° relative to the respective longitudinal axes of the handle and of the blade, the orientation of the coils covering the junction area progressively changing from the orientation of the coils covering part of the handle to the orientation of the coils covering at least part of the blade.

2. A hockey stick as claimed in claim 1, further including pieces of woven high tensional strength fabric applied between the blade and the yarn winding against the sides of the blade, and extending across the lower edge of the blade and heel portion of the handle, and terminating short of the top edge of the blade.

3. A hockey stick as claimed in claim 1, further including an adhesive material applied to the blade, the junction area and the lower part of the handle, covering and wetting the winding and adhering the latter to the hockey stick.

4. A hockey stick as claimed in claim 2, wherein the outer end of the blade is covered on both sides with a piece of woven glass fiber fabric and located between the yarn and the blade.

* * * * *